US007431542B2

(12) United States Patent
Hessman

(10) Patent No.: US 7,431,542 B2
(45) Date of Patent: Oct. 7, 2008

(54) COATED CUTTING INSERT

(75) Inventor: Ingemar Hessman, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 267 days.

(21) Appl. No.: 11/261,910

(22) Filed: Oct. 31, 2005

(65) Prior Publication Data

US 2006/0147755 A1 Jul. 6, 2006

(30) Foreign Application Priority Data

Jan. 3, 2005 (SE) ..... 0500016

(51) Int. Cl.
*B32B 9/00* (2006.01)
*C23C 16/30* (2006.01)

(52) U.S. Cl. ..... 407/119; 76/44; 51/307; 51/309; 427/249.19; 427/255.391; 427/368; 427/419.2; 427/419.7; 428/156; 428/176; 428/216; 428/325; 428/698; 428/701; 428/702

(58) Field of Classification Search ..... 428/156, 428/176, 325, 216, 336, 698, 699, 701, 702, 428/472, 174; 51/307, 309; 407/119; 76/44; 427/249.17, 249.19, 255.28, 255.29, 255.391, 427/368, 419.1, 419.2, 419.7
See application file for complete search history.

(56) References Cited

U.S. PATENT DOCUMENTS

| | | | | |
|---|---|---|---|---|
| 5,074,721 | A | 12/1991 | Kress et al. | |
| 5,863,640 | A * | 1/1999 | Ljungberg et al. | 428/702 |
| 5,945,207 | A * | 8/1999 | Kutscher et al. | 428/216 |
| 5,976,707 | A * | 11/1999 | Grab | 428/698 |
| 6,177,178 | B1 | 1/2001 | Ostlund et al. | |
| 6,200,671 | B1 * | 3/2001 | Lindskog et al. | 428/336 |
| 6,221,479 | B1 * | 4/2001 | Waldenstrom et al. | 428/699 |
| 6,261,673 | B1 * | 7/2001 | Reineck et al. | 428/216 |
| 6,333,098 | B1 | 12/2001 | Olsson et al. | |
| 6,344,265 | B1 * | 2/2002 | Blomstedt et al. | 428/325 |
| 6,406,224 | B1 * | 6/2002 | Ostlund et al. | 428/116 |
| 6,706,327 | B2 * | 3/2004 | Blomstedt et al. | 427/372.2 |
| 6,767,583 | B2 * | 7/2004 | Nordgren et al. | 427/255.28 |
| 2002/0051886 | A1 | 5/2002 | Blomstedt et al. | |
| 2004/0033393 | A1 | 2/2004 | Nordgren et al. | |

FOREIGN PATENT DOCUMENTS

| | | |
|---|---|---|
| EP | 0 709 484 | 4/1999 |
| EP | 0 753 603 | 1/2000 |
| EP | 0 874 919 | 2/2002 |
| JP | 1-184218 | 7/1989 |
| WO | WO 01/16389 | 3/2001 |

* cited by examiner

*Primary Examiner*—Archene Turner
(74) *Attorney, Agent, or Firm*—Drinker Biddle & Reath LLP

(57) ABSTRACT

A cutting insert preferably for milling of extremely highly alloyed grey cast iron, of a substrate and a coating and methods of making and using the insert are disclosed. The cemented carbide substrate includes WC, of from about 3 to about 8 weight-% Co and less than about 0.5 weight-% carbides of metals from groups IVb, Vb or VIb of the periodic table. The coating has a first, innermost layer of $TiC_xN_yO_z$ with x+y+z=1, y>x and z less than about 0.2, preferably y greater than about 0.8, and z=0, with equiaxed grains with size less than about 0.5 μm and a total thickness of from about 0.1 to about 1.5 μm, a layer of $TiC_xN_y$ with x+y=1, x greater than about 0.3 and y greater than about 0.3, preferably x greater than or equal to about 0.5, with a thickness of greater than about 3 to about 5 μm with columnar grains with an average diameter of less than about 5 μm, a layer of a smooth, fine-grained, grain size of from about 0.5 to about 2 μm, κ-$Al_2O_3$ with a thickness of from about 0.5 to about 3 μm and an outermost layer of TiN with a thickness of less than about 2 μm.

16 Claims, No Drawings

COATED CUTTING INSERT

BACKGROUND OF THE INVENTION

The present invention relates to a coated cemented carbide insert particularly useful for dry milling of extremely highly alloyed grey cast iron in particular, grey cast iron further alloyed with carbide forming elements such as Cr, Ti and Mo.

U.S. Pat. No. 6,177,178 discloses a coated milling insert particularly useful for milling in low and medium alloyed steels with or without raw surface zones during wet or dry conditions. The insert is characterized by a WC—Co cemented carbide with a low content of cubic carbides and a highly W-alloyed binder phase and a coating including an inner layer of $TiC_xN_yO_z$ with columnar grains, a layer of $\kappa$-$Al_2O_3$ and, preferably, a top layer of TiN.

U.S. Pat. No. 6,333,098 discloses a coated cutting insert particularly useful for dry milling of grey cast iron. The insert is characterized by a WC—Co cemented carbide substrate and a coating including an innermost layer of $TiC_xN_yO_z$ with columnar grains and a top coating of a fine-grained $\alpha$-$Al_2O_3$ layer.

Grey cast-iron is a material, which, in general, is reasonably easy to machine with cemented carbide tools. Often, long tool life can be obtained. However, the machinability of cast iron can vary considerably. The tool life may be influenced significantly by small variations in the chemical composition within the material, which may be related to the casting technique used, such as the cooling conditions. Other causes for variations are the casting skin and sand inclusions, if present, or even the stability of the machine used for cutting the material.

Extremely highly alloyed cast iron is used in some types of car engines in order to obtain high strength of the engine.

With extremely highly alloyed grey cast iron is herein meant cast iron alloyed with additives such as Cr, Mo, Ti, which form different types of carbides in the matrix. Preferably, the contents of these elements are Cr greater than about 0.15, Mo greater than about 0.04, and/or Ti greater than about 0.015 weight-%.

When machining such cast irons by coated milling inserts, abrasive wear type is dominating because of the presence of the carbides. That is, fragments or individual grains of the layers and later also parts of the cemented carbide are successively pulled away from the cutting edge by the work piece chip formed. Such wear mechanism is further accelerated by the formation of cracks about 50 μm apart along and perpendicular to the cutting edge. As soon as the coating is worn out, the underlying cemented carbide will wear fast. The increased specific surface contributes to higher cutting forces, increased temperature and increased chemical reaction between workpiece material and the coating/substrate.

OBJECTS AND SUMMARY OF THE INVENTION

It is an object of the present invention to provide a coated cutting tool insert with a reliable and stable tool life in mass volume production and in particular when unmanned production is employed.

It is a further object of the present invention to provide a coated cutting tool insert that can withstand or delay comb crack formation as long as possible and a coating that adheres well to the cemented carbide.

It is a further object of the present invention to provide a coated cutting tool insert with low adhesion forces between the chip and the coating and with a high internal strength.

It is a still further object of the present invention to provide a coated cutting tool insert particularly useful for milling of extremely highly alloyed cast iron.

In one aspect of the invention, there is provided a cutting insert comprising a substrate and a coating wherein said substrate comprises WC with an average grain size of from about 1 to about 2.5 μm, from about 5 to about 8 wt-% Co and less than about 0.5 wt-% cubic carbides of metals Ta, Ti and or Nb and a highly W-alloyed binder phase with a CW-ratio of 0.75-0.93 with less than about 1 vol-% eta-phase and said coating comprises

- a first, innermost layer of $TiC_xN_yO_z$ with x+y+z=1, y>x and z less than about 0.2 with equiaxed grains with size less than about 0.5 μm and a total thickness of from about 0.1 to about 1.5 μm,
- a layer of $TiC_xN_y$ with x+y=1, x greater than about 0.3 and y greater than about 0.3 with a thickness of greater than about 3 to about 5 μm with columnar grains with an average diameter of less than about 5 μm,
- a layer of a smooth, fine-grained, grain size of from about 0.5 to about 2 μm, $\kappa$-$Al_2O_3$ with a thickness of from about 0.5 to about 3 μm and
- an outermost layer of TiN with a thickness of less than about 2 μm.

In another aspect of the invention, there is provided a method of making a cutting insert comprising a substrate of a cemented carbide body consisting of WC with an average grain size of from about 1 to about 2.5 μm, from about 5 to about 8 wt-% Co and less than about 0.5 wt-% cubic carbides of metals Ta, Ti and or Nb and a highly W-alloyed binder phase with a CW-ratio of 0.75-0.93 with less than about 1 vol-% eta-phase and a coating, the method comprising the steps of coating said substrate with

- a first, innermost layer of $TiC_xN_yO_z$ with x+y+z=1, y>x and z less than about 0.2 with equiaxed grains with size less than about 0.5 μm and a thickness of from about 0.1 to about 1.5 μm, using known CVD-methods,
- a layer of $TiC_xN_y$ with x+y=1, x greater than about 0.3 and y greater than about 0.3 with a thickness of greater than about 3 to about 5 μm with columnar grains with an average diameter of less than about 5 μm, deposited by MTCVD-technique, using acetonitrile as the carbon and nitrogen source for forming the layer in the temperature range of from about 700 to about 900° C.
- a layer of a smooth, fine-grained, grain size of from about 0.5 to about 2 μm, $\kappa$-$Al_2O_3$ with a thickness of from about 0.5 to about 3 μm according to known CVD-technique and
- an outermost layer of TiN with a thickness of less than about 2 using known CVD-methods.

In still another aspect of the invention, there is provided the use of tool inserts as described above for use as inserts for dry milling of extremely highly alloyed cast iron at a cutting speed of from about 70 to about 220 m/min and a feed of from about 0.15 to about 0.35 mm/tooth depending on cutting speed and insert geometry.

DETAILED DESCRIPTION OF THE INVENTION

According to the present invention, a cutting tool insert is provided with a cemented carbide body of a composition of from about 5 to about 8 wt-% Co, preferably of from about 5 to about 7 wt-% Co, less than about 0.5 wt-%, preferably 0 wt-%,cubic carbides of the metals Ti, Ta and/or Nb and balance WC. The average grain size of the WC is in the range of from about 1 to about 2.5 μm. The cobalt binder phase is highly alloyed with W. The content of W in the binder phase can be expressed as the $$CW\text{-ratio}=M_s/(\text{wt-\% Co}\cdot 0.0161),$$

where $M_s$ is the measured saturation magnetization of the cemented carbide body in $hAm^2/kg$ and wt-% Co is the weight percentage of Co in the cemented carbide. The CW-value is a function of the W content in the Co inder phase. A low CW-value corresponds to a high W-content in the binder phase.

According to the present invention, improved cutting performance is achieved if the cemented carbide body has a CW-ratio of from about 0.75 to about 0.93, preferably of from about 0.80 to about 0.90. The cemented carbide body may contain small amounts, less than about 1 volume-%, of eta phase ($M_6C$), without any detrimental effect.

The radius of the uncoated cutting edge of the insert is from about 20 to about 50 μm, preferably from about 30 to about 40 μm.

The coating comprises a first, innermost layer of $TiC_xN_yO_z$ with x+y+z=1, y>x and z less than about 0.2, preferably y greater than about 0.8, and z=0, with equiaxed grains with size less than about 0.5 μm and a thickness of from about 0.1 to about 1.5 μm, a layer of $TiC_xN_y$ with x+y=1, x greater than about 0.3 and y greater than about 0.3, preferably x greater than or equal to about 0.5, with a thickness of greater than about 3 to about 5 μm with columnar grains with an average diameter of less than about 5 μm, a layer of a smooth, fine-grained, grain size of from about 0.5 to about 2 μm, $Al_2O_3$ consisting essentially of the κ-phase. However, the layer may contain small amounts, 1-3 vol-%, of the θ- or the α-phases as determined by XRD-measurement. The $Al_2O_3$-layer has a thickness of from about 0.5 to about 3 μm, preferably from about 0.5 to about 2 μm, and most preferably of from about 0.5 to about 1.5 μm.

a TiN-layer less than about 2, preferably from about 0.5 to about 1.5, μm. This outermost TiN-layer has a surface roughness $R_{max}\leqq 0.4$ μm over a length of 10 μm at least on the cutting edge. The TiN-layer is preferably missing along the cutting edge and the underlying alumina layer may be partly or completely missing along the cutting edge.

The present invention also relates to a method of making a coated cemented carbide body of a composition 5-8 wt-% Co, preferably from about 5 to about 7 wt-% Co, less than about 0.5 wt-%, preferably 0 wt-%, cubic carbides of the metals Ti, Ta and/or Nb and balance WC. The average grain size of the WC is in the range of from about 1 to about 2.5 μm. The cobalt binder phase is highly alloyed with W. The content of W in the binder phase expressed as CW-ratio is from about 0.75 to about 0.93, preferably from about 0.80 to about 0.90.

The uncoated cutting edge is provided with an edge radius of from about 20 to about 50 μm, preferably from about 30 to about 40 μm.

The coating comprises:

a first, innermost layer of $TiC_xN_yO_z$ with x+y+z=1, y>x and z less than about 0.2, preferably y greater than about 0.8, and z=0, with equiaxed grains with size less than about 0.5 μm and a thickness of from about 0.1 to about 1.5 μm, using known CVD-methods a layer of $TiC_xN_y$ with x+y=1, x greater than about 0.3 and y greater than about 0.3, preferably x greater than or equal to about 0.5, with a thickness of greater than about 3 to about 5 μm with columnar grains with an average diameter of less than about 5 μm, deposited by MTCVD-technique, using acetonitrile as the carbon and nitrogen source for forming the layer in the temperature range of from about 700 to about 900° C., a layer of a smooth, fine-grained, grain size of from about 0.5 to about 2 μm, κ-$Al_2O_3$ with a thickness of from about 0.5 to about 3 μm, preferably of from about 0.5 to about 2 μm, most preferably of from about 0.5 to about 1.5 μm, according to known CVD-technique and a less than about 2, preferably from about 0.5 to about 1.5, μm, thick TiN-layer using known CVD-methods. This outermost TiN-layer is preferably brushed with, e.g., a SiC based brush to a surface roughness $R_{max}\leqq 0.4$ μm over a length of 10 μm at least on the cutting edge. The TiN-layer is preferably removed along the cutting edge and the underlying alumina layer may be partly or completely removed along the cutting edge.

The present invention also relates to the use of inserts according to above for dry milling of extremely highly alloyed cast iron, preferably containing Cr greater than about 0.15, Mo greater than about 0.04, and/or Ti greater than about 0.015 weight-% at a cutting speed of from about 70 to about 220 m/min and a feed of from about 0.15 to about 0.35 mm/tooth depending on cutting speed and insert geometry.

The invention is additionally illustrated in connection with the following examples, which are to be considered as illustrative of the present invention. It should be understood, however, that the invention is not limited to the specific details of the examples.

EXAMPLE 1

A) Cemented carbide milling inserts in accordance with the invention with the composition 6.0 wt-% Co and balance WC were sintered in a conventional way at 1410° C. and cooled down to 1200° C. in 0.6 bar $H_2$ giving inserts with a binder phase alloyed with W, corresponding to a CW-ratio of 0.9. The average WC grain size was 1.3 μm. After conventional edge rounding-treatment to an edge radius of 35 μm, the inserts were coated with a 0.5 μm equiaxed Ti(C,N)-layer (with a high nitrogen content corresponding to an estimated C/N-ratio of 0.05) followed by a 4 μm thick Ti(C,N)-layer with columnar grains using MTCVD-technique (temperature of 885-850° C. and $CH_3CN$ as the carbon/nitrogen source). In subsequent steps during the same coating cycle, a 1.0 μm thick layer of $Al_2O_3$ was deposited using a temperature of 970° C. and a concentration of $H_2S$ dopant of 0.4 weight-% as disclosed in EP-A-523 021. Finally, a 1.0 μm layer of TiN was deposited on top according to known CVD-technique. XRD-measurement showed that the $Al_2O_3$-layer consisted of 100% κ-phase. The cemented carbide body had a WC grain size averaging 1.8 μm. The coated inserts were dry brushed by a nylon straw brush containing SiC grains. Examination of the brushed inserts in a light microscope showed that the thin TiN-layer had been brushed away only along the cutting edge leaving there a smooth $Al_2O_3$-layer surface. Coating thickness measurements on cross-sectioned brushed samples showed no reduction of the coating along the edge line except for the outer TiN-layer that was removed.

EXAMPLE 2

Inserts according to the present invention were tested in face milling of engine blocks in highly alloyed "Grauguss" GG25 (a highly alloyed cast iron containing 0.42 wt-% Cr and 0.03 wt-% Ti.

Tool: Sandvik Coromant R260.31-315
Number of inserts: 50 PCs
Criterion: Surface finish and work piece frittering.
Reference: TNEF 1204EN competitor grade
Cutting data
Cutting speed: Vc=187 m/min
Feed per tooth: Fz=0.17 mm per tooth
Depth of cut: Ap=4 mm
Dry conditions
Tool life reference: 460 cylinder blocks in production.
Tool life of invention: 613 cylinder heads.
Average of 5 tests.

The test shows an increase of tool life of 33% with improved surface finish and productivity.

EXAMPLE 3

Inserts according to the present invention were tested in face milling of engine blocks in extremely highly alloyed grey cast iron GL04+CR (a highly alloyed cast iron containing 0.35 wt-% Cr.

Tool: Sandvik Coromant R260.31-250
Number of inserts: 40 PCs
Criterion: Surface finish and work piece out of tolerance.
Reference: TNEF 1204AN-CA in grade GC3020 from Sandvik Coromant
Cutting data
Cutting speed: Vc=126 m/min
Feed per tooth: Fz=0.2 mm per tooth
Depth of cut: Ap=3.5 mm
Dry conditions
Tool life with reference: 1100 cylinder blocks in production.
Tool life of invention: 1745 cylinder heads.
Average of 5 tests.

The test shows an increase of tool life of 58% with improved surface finish and tolerances.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. Cutting insert comprising a substrate and a coating wherein said substrate comprises WC with an average grain size of from about 1 to about 2.5 μm, from about 5 to about 8 wt-% Co and 0 wt-% cubic carbides of metals Ta, Ti and or Nb and a highly W-alloyed binder phase with a CW-ratio of 0.75-0.93 with less than about 1 vol-% eta-phase and said coating comprises a first, innermost layer of $TiC_xN_yO_z$ with x+y+z=1, y>x and z less than about 0.2 with equiaxed grains with size less than about 0.5 μm and a total thickness of from about 0.1 to about 1.5 μm, a layer of $TiC_xN_y$ with x+y=1, x greater than about 0.3 and y greater than about 0.3 with a thickness of greater than about 3 to about 5 μm with columnar grains with an average diameter of less than about 5 μm, a layer of a smooth, fine-grained, grain size of from about 0.5 to about 2 μm, κ-$Al_2O_3$ with a thickness of from about 0.5 to about 3 μm, and an outermost layer of TiN with a thickness of less than about 2 μm, wherein the outermost TiN-layer is missing along the cutting edge, and wherein a radius of the uncoated cutting edge is from about 20 to about 50 μm.

2. The cutting insert of claim 1 wherein the outermost TiN-layer has a surface roughness Rmax≦0.4 μm over a length of 10 μm.

3. The cutting insert of claim 1 wherein the cobalt content of said substrate is from about 5 to about 7 wt-%, in said first, innermost layer, y is greater than 0.8 and z=0, in said layer of $TiC_xN_y$, x is greater than or equal to 0.5, said κ-$Al_2O_3$ layer has a thickness of from about 0.5 to about 2 μm, and said outermost layer of TiN has a thickness of from about 0.5 to about 1.5 μm.

4. The cutting insert of claim 1 wherein the radius of the uncoated cutting edge is from about 30 to about 40 μm.

5. The cutting insert according to claim 1 wherein the outer layer of TiN has a surface roughness $R_{max}$≦0.4 mm over a length of 10 μm at least on an active part of a cutting edge.

6. The cutting insert according to claim 1 wherein the layer κ-$Al_2O_3$ includes 1-3 vol-% of θ-$Al_2O_3$ or α-$Al_2O_3$.

7. The cutting insert according to claim 1 wherein the CW-ratio is 0.8 to 0.9.

8. The cutting insert according to claim 1 wherein the thickness of the layer of κ-$Al_2O_3$ is about 0.5 to about 1.75 μm.

9. Use of inserts of claim 1 for dry milling of extremely highly alloyed cast iron at a cutting speed of from about 70 to about 220 m/min and a feed of from about 0.15 to about 0.35 mm/tooth depending on cutting speed and insert geometry.

10. In the use of claim 9 wherein said highly alloyed cast iron contains less than about 0.15 wt-% Cr, less than about 0.04 wt-% Mo and less than about 0.015 wt-% Ti.

11. Method of making a cutting insert comprising a substrate of a cemented carbide body comprising WC with an average grain size of from about 1 to about 2.5 μm, from about 5 to about 8 wt-% Co and 0 wt-% cubic carbides of metals Ta, Ti and or Nb and a highly W-alloyed binder phase with a CW-ratio of 0.75-0.93 with less than about 1 vol-% eta-phase and a coating, the method comprising the steps of coating said substrate with a first, innermost layer of $TiC_xN_yO_z$ with x+y+z=1, y>x and z less than about 0.2 with equiaxed grains with size les than about 0.5 μm and a thickness of from about 0.1 to about 1.5 μm, using known CVD-methods, a layer of $TiC_xN_y$ with x+y=1, x greater than about 0.3 and y greater than about 0.3 with a thickness of greater than about 3 to about 5 μm with columnar grains with an average diameter of less than about 5 μm, deposited by MTCVD-technique, using acetonitrile as the carbon and nitrogen source for forming the layer in the temperature range of from about 700 to about 900° C.

a layer of a smooth, fine-grained, grain size of from about 0.5 to about 2 μm, κ-$Al_2O_3$ with a thickness of from about 0.5 to about 3 μm according to known CVD-technique and an outermost layer of TiN with a thickness of less than about 2 μm using known CVD-method; and removing the outermost TiN-layer along the cutting edge by brushing, wherein the uncoated cutting edge has a radius of 20-50 μm.

12. The method of claim 11 comprising brushing the outermost TiN-layer to a surface roughness Rmax≦0.4 μm over a length of 10 μm.

13. The method of claim 12 comprising brushing the outermost TiN-layer with a SiC-based brush.

14. The method of claim 11 wherein said substrate has a Co-content of from about 5 to about 7 wt-% and said substrate is coated with a coating in which in said first, innermost layer, y is greater than about 0.8 and z=0, in said layer of $TiC_xN_y$, x is greater than or equal to about 0.5, said κ-$Al_2O_3$ layer has a thickness of from about 0.5 to about μm, and said outermost layer of TiN has a thickness of from about 0.5 to about 1.5 μm.

15. The method of claim 11 wherein said substrate is coated with a coating in which in the κ-$Al_2O_3$ layer, the thickness is from about 0.5 to about 1.5 μm.

16. The method of claim 11 comprising providing the uncoated cutting edge with a radius of from about 30 to about 40 μm before the coating steps.

* * * * *